US005347940A

United States Patent [19]

Hori et al.

[11] Patent Number: 5,347,940

[45] Date of Patent: Sep. 20, 1994

[54] SEWING MACHINE AND PATTERN SELECTION APPARATUS

[75] Inventors: Masayuki Hori, Gifu; Yoshiyuki Uyama, Nagoya, both of Japan

[73] Assignee: Brother Kogyo Kabushiki Kaisha, Nagoya, Japan

[21] Appl. No.: 87,077

[22] Filed: Jul. 7, 1993

[30] Foreign Application Priority Data

Aug. 28, 1992 [JP] Japan ..... 4-229929

[51] Int. Cl.[5] ..... D05B 19/00

[52] U.S. Cl. ..... 112/121.11; 112/445; 112/458; 112/266.1

[58] Field of Search ..... 112/121.11, 445, 453, 112/454, 456, 457, 458, 266.1, 262.1, 121.12; 345/123, 124, 157

[56] References Cited

U.S. PATENT DOCUMENTS 4,323,022 4/1982 Hanyu et al. ..... 112/458 X
4,467,740 8/1984 Makabe et al. ..... 112/453
4,499,836 2/1985 Meier et al. ..... 112/454 X
4,860,678 8/1989 Skogward ..... 112/445
5,044,291 9/1991 Kobayashi .
5,097,779 3/1992 Ishikawa et al. .
5,156,107 10/1992 Kyuno et al. .

*Primary Examiner*—Peter Nerbun
*Attorney, Agent, or Firm*—Oliff & Berridge

[57] ABSTRACT

A pattern selection apparatus displays patterns and allows any of the displayed patterns to be directly selected. The apparatus comprises a control circuit, a display unit, an item designating dial and a selection establishing key. The control circuit indicates on the display unit where a cursor-highlighted displayed pattern is located relative to all the patterns under the same subset heading. As the cursor is moved in response to rotation of the item designating dial, the pattern location indication is correspondingly changed. Pushing the selection establishing key selects the cursor-highlighted pattern. Thus, any of the patterns displayed on the display unit is selected quickly and easily.

21 Claims, 11 Drawing Sheets

SEWING MACHINE AND PATTERN SELECTION APPARATUS

BACKGROUND OF THE INVENTION

1. Field of the Invention

This invention relates to a pattern selection apparatus capable of displaying patterns on a display unit and allowing any of the displayed patterns to be directly selected.

2. Description of the Related Art

A conventional pattern selection apparatus comprises a recording medium such as a ROM and a display unit equipped with a touch panel. The recording medium contains predetermined data for a plurality of patterns. The display unit displays patterns based on the pattern data and allows any one pattern to be selected with the touch panel. When an operator touches an appropriate position on the display unit screen, the displayed pattern corresponding to the touched position is selected. The recording medium contains data about numerous patterns. In most cases, it is impossible to display all of the patterns on the screen at once. Instead, the patterns are displayed one after another when the operator scrolls the screen. When a desired pattern is reached, the operator selects that pattern.

Another type of conventional pattern selection apparatus comprises numeric keys that allow the operator to select the number corresponding to each of the individual prestored patterns.

With the former type of pattern selection apparatus, which allows the operator to select a pattern from among various patterns as they are scrolled, it is difficult for the operator to know where the currently displayed pattern is located, relative to the other patterns stored in the ROM. That is, the operator finds it difficult to know which way to scroll the screen to reach the desired pattern most efficiently and quickly. Thus, the time needed for the operator to search for and determine the next pattern to be selected is needlessly increased.

With the latter type of pattern selection apparatus, which allows the operator to directly select a pattern number with numeric keys, the operator often does not enter the pattern currently displayed on the screen. Thus, if the operator erroneously operates the numeric keys, a number that does not represent the desired pattern is entered, and the wrong pattern is selected.

SUMMARY OF THE INVENTION

This invention provides a pattern selection apparatus comprising: storage means for storing a plurality of patterns in a predetermined order; display means for displaying the plurality of patterns stored in the storage means; control means for scrolling the displayed patterns in a predetermined order; and position indicating means for indicating the relative location of the displayed pattern among the plurality of patterns stored in the storage means.

With this pattern selection apparatus, the control means allows the patterns stored in the storage means to be displayed and scrolled on the display means. During scrolling, the position indicating means indicates where the currently displayed pattern is located relative to the plurality of patterns stored in the storage means. This permits the operator to more efficiently and quickly select the desired pattern.

These and other objects, features and advantages of this invention will become apparent upon a reading of the following description and appended drawings.

BRIEF DESCRIPTION OF THE DRAWINGS

A preferred embodiment of the present invention will be described in detail with reference to the following figures, wherein.

DESCRIPTION OF THE PREFERRED EMBODIMENT

Figure 1:
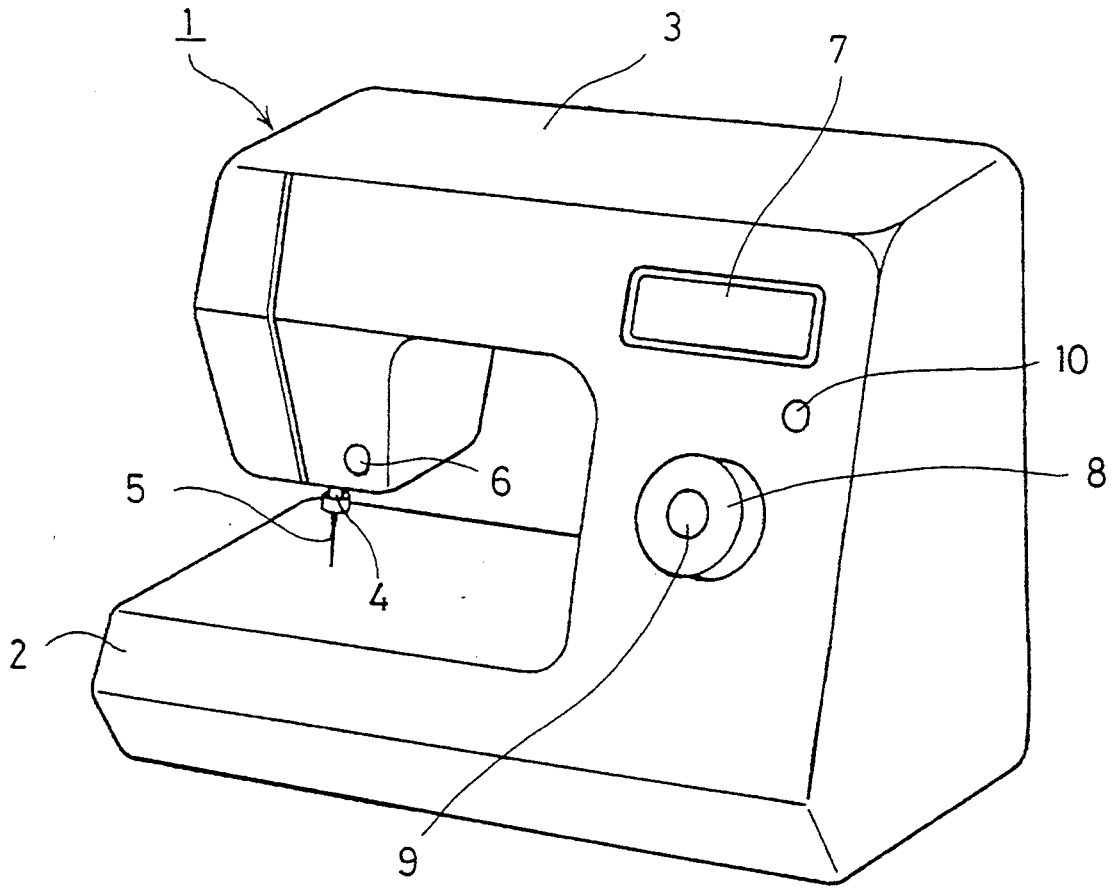
FIG. 1 is a perspective view of a sewing machine having a pattern selection apparatus embodying the invention.

One preferred embodiment of the invention is described with reference to the accompanying drawings. FIGS. 1 through 7 show an overall design of the sewing machine comprising the pattern selection apparatus embodying this invention. A sewing machine 1 contains a machine bed 2 and a machine arm 3. The machine arm 3 is supported by a right-hand upright portion and extends to the left. The left end of the machine arm 3 has a vertically movable needle rod 4. A sewing needle 5 is removably attached to the lower end of the needle rod 4.

Inside the machine bed 2 is a horizontal hook, not shown, which acts as a thread ring catcher. The hook rotates in synchronism with the vertical motion of the needle rod 4. Feed teeth, not shown, are provided to feed cloth to be sewn synchronously with the vertical motion of the needle rod 4. A vertically movable cloth retaining rod (not shown) is located behind the needle rod 4. A cloth retaining member, not shown, is attached to the lower end of the cloth retaining rod.

A start/stop switch 6 is located on the left part of the machine arm 3. The start/stop portion 6 is activated when pushed. Repeatedly pushing the switch 6 starts and stops the sewing operation.

A liquid-crystal display (LCD) 7 is located in an upper part of the upright portion supporting the machine arm 3. The LCD 7 displays a plurality of selectable items, such as individual sewing patterns, or classes or subsets of pattern types. A rotatable item designating dial 8 is located under the LCD 7.

Figure 7:
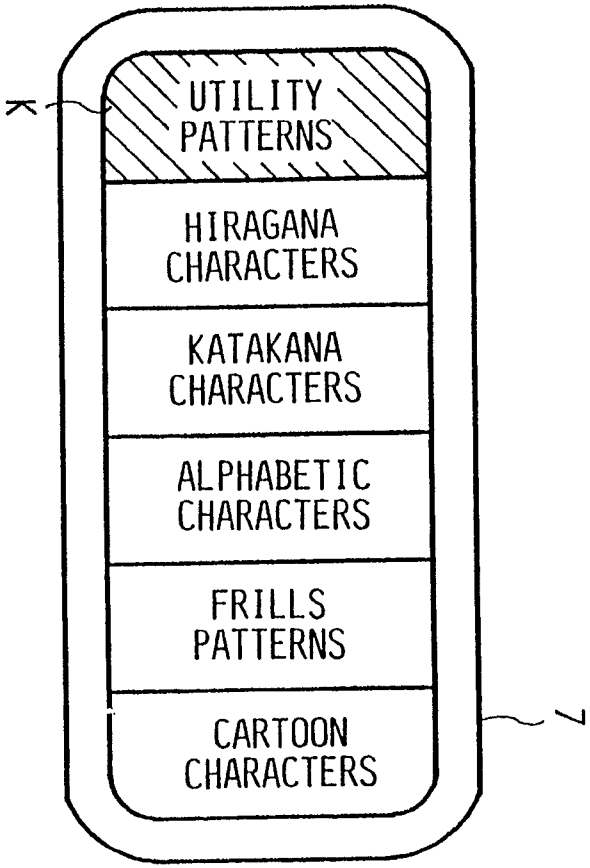
FIG. 7 is a front view depicting a liquid-crystal display (LCD) of this invention.
Figure 8A:
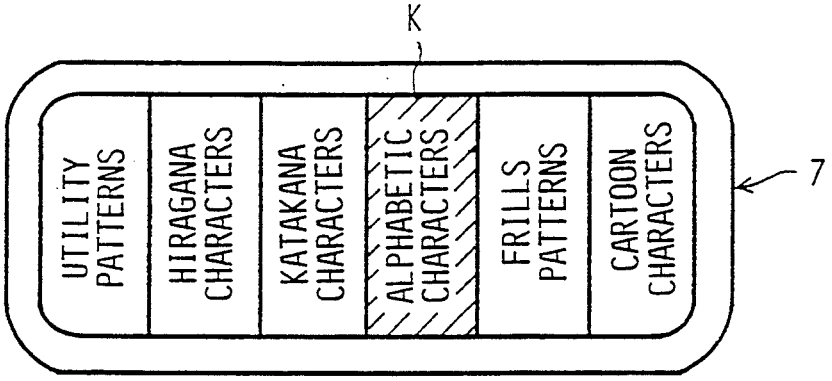
FIGS. 8A through 8D are front views of screens as they appear on the LCD.
Figure 8B:
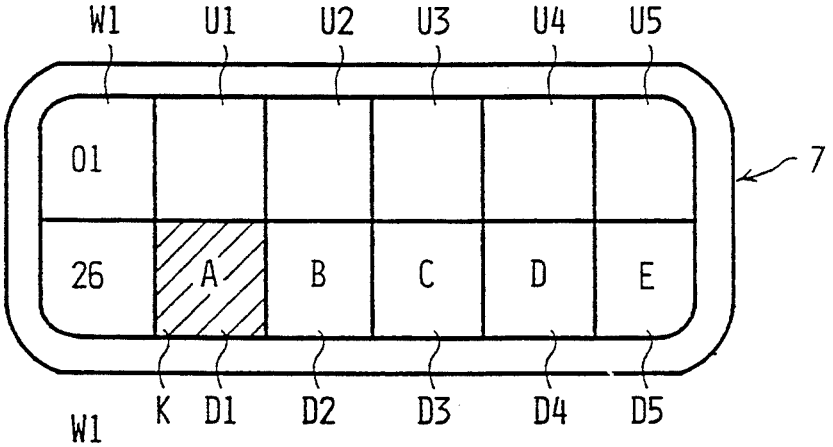

In an item selection mode, the LCD 7 displays up to six vertically separated items, as shown in FIG. 7. In a pattern selection mode, vertically oblong region W1 is displaced in the leftmost position of the LCD 7, as shown in FIG. 8B. To the right of the region W1, five upper regions U1 through U5 and five lower regions D1 through D5 are located.

That is, the screen of the LCD 7 is divided into 11 regions. A cursor K is a reverse video display region of the LCD 7, shown shaded in FIG. 7. On the display screen, the cursor K moves in response to rotation of the item designating dial 8. The upper five regions U1 through U5 display the patterns already selected and established by the operator. The lower five regions D1 through D5 display patterns that may be designated by the cursor K.

In FIG. 8B, the region W1 indicates, in the form of a fraction, where the pattern indicated by the cursor K is located among all the patterns stored. The fraction is formed by displaying a first number representing the currently displayed pattern over a second number representing a total number of the stored patterns. Alternately, the second number represents the number of patterns associated with a predefined subset of the stored patterns. Such subsets are, for example, utility patterns, hiranga characters, katakana characters, alphabetic characters, frills patterns and cartoon characters, as shown in FIG. 8A.

As shown in FIG. 1, a selection establishing key 9 is located in the center of the item designating dial 8. The selection establishing key 9 is activated when pushed. Pushing the selection establishing key 9 selects the item or pattern designated by the cursor K. Below and to the right of the LCD 7 is a clear key 10, which is activated when pushed. Pushing the clear key 10 clears the items and/or patterns selected by the selection establishing key 9 and restores the state in effect after the previous time the selection establishing key 9 was operated.

Figure 2:
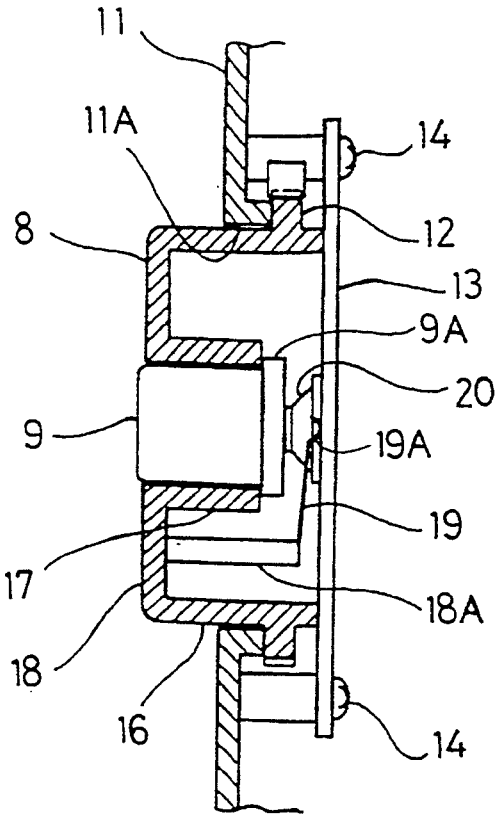
FIG. 2 is a longitudinal cross-sectional view of an item designating dial and the surrounding environment.
Figure 3:
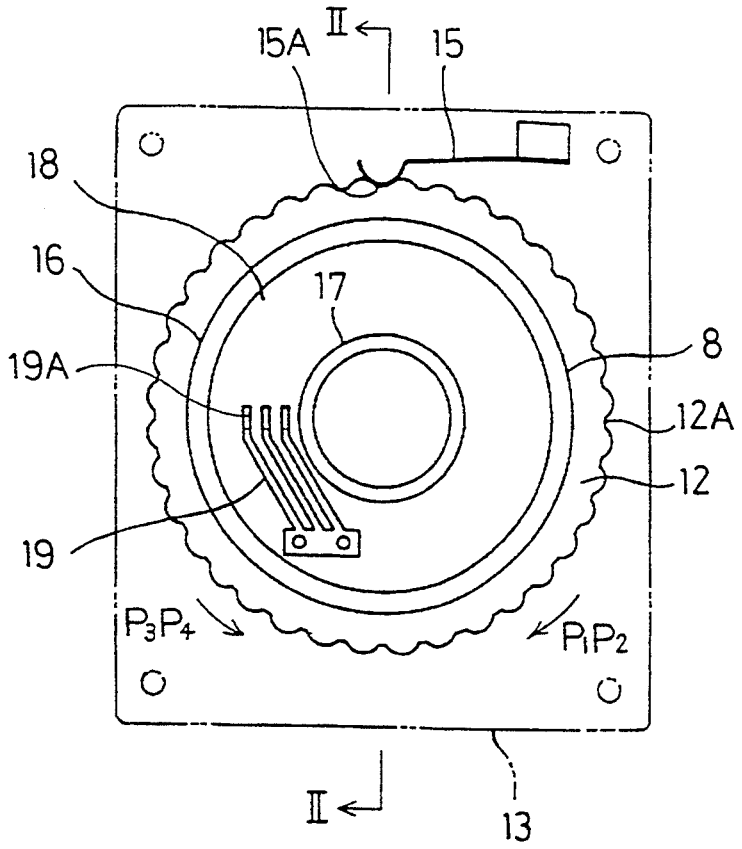
FIG. 3 is a longitudinal front view of the item designating dial and the surrounding environment.

The structure of the item designating dial 8 and the selection establishing key 9 is shown in FIGS. 2 and 3. As shown in FIG. 2, the item designating dial 8 is a double-walled cylinder rotatably fit into a round attaching hole 11A. The attaching hole 11A is formed in a front cover 11 of the machine arm 3. A collar 12 projects from the right-hand portion of the outer circumference of the item designating dial 8 and contacts the edge of the attaching hole 11A. A dial substrate 13 is fastened by screws 14 to the back of the front cover 11. The dial substrate 13 covers the right-hand edge (as shown in FIG. 2) of the dial 8. This prevents the item designating dial 8 dislodging in the axial direction.

A large number of positioning depressions 12A are formed around the outer circumference of the collar 12 of the item designating dial 8, as shown in FIG. 3. A plate spring 15 is fixed to the back of the front cover 11 above the collar 12. A half-circular projecting part 15A formed at the tip of the plate spring 15 engages with the depressions 12A formed around the circumference of the collar 12. The half-circular projecting part 15A engages one the depressions 12A to keep the item designating dial 8 in the position where it last stopped. The spring force of the plate spring 15 is not so strong that the item designating dial 8 cannot be easily rotated against the spring force.

As illustrated in FIG. 2, a support member 18A projects backwardly from the back of a closure wall 18. The closure wall 18 extends between the front end of the outer cylindrical wall 16 and the inner cylindrical wall 17 of the item designating dial 8. The back end of the support member 18A is equipped with a movable contact plate spring 19. The front of the dial substrate 13 has a first and a second conductor pattern (not shown). A contact part 19A of the movable contact plate spring 19 contacts the first and second conductor patterns.

Figure 4:
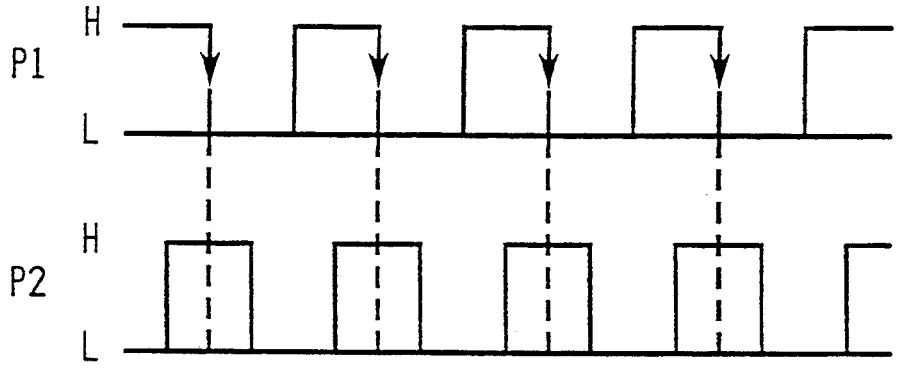
FIG. 4 is a timing chart of a pulse signal that is output when the item designating dial is turned clockwise.

When the operator turns the item designating dial 8 clockwise, a first and a second output terminal of the first and second conductor patterns formed on the dial substrate 13 send pulse signals P1 and P2, as shown in FIG. 4, to a control circuit 30 in response to the item designating dial's rotation. In this case, the output level of the pulse signal P2 is HIGH at each trailing edge of the pulse signal P1. This causes the control circuit 30 to determine that the item designating dial 8 is turned clockwise.

Figure 5:
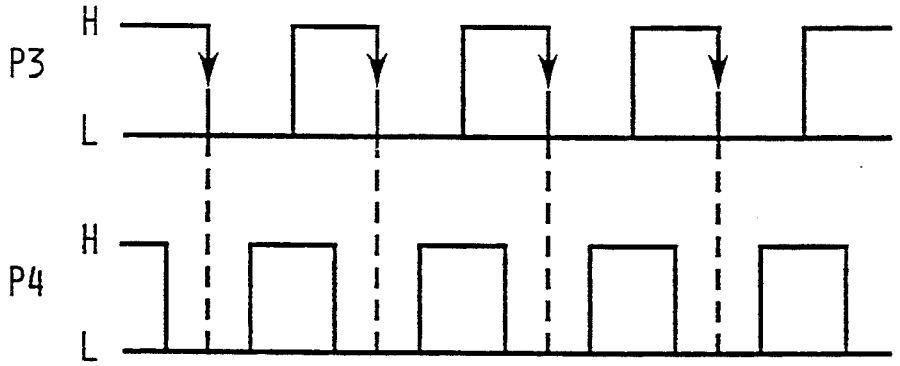
FIG. 5 is a timing chart of a pulse signal that is output when the item designating dial is turned counterclockwise.

When the operator turns the item designating dial 8 counterclockwise, the first and the second output terminal of the conductor patterns on the dial substrate 13 output pulse signals P3 and P4, as shown in FIG. 5, to the control circuit 30 in response to the designating dial's rotation. In this case, the output level of the pulse signal P4 is LOW at each trailing edge of the pulse signal P3. This causes the control circuit 30 to determine that the item designating dial 8 is turned counterclockwise. In an alternate embodiment, the item designating dial 8 is replaced with a pair of buttons directly inputting the pulse signals P1–P4. A first button scrolls the displayed patterns in a left or decreasing direction, while the second button scrolls the displayed patterns in a right or ascending direction. The first button therefore outputs the pulse signals P1 and P2, which the second button outputs the pulse signals P3 and P4.

The selection establishing key 9 is contained within the inner cylindrical wall 17 of the item designating dial 8 and moves in the axial direction. The back end of the selection establishing key 9 contacts a pressure activated part of a rubber switch 20 disposed in the front middle of the dial substrate 13. The rubber switch 20 has a conductive rubber contact having an elastic force that pushes the selection establishing key 9 forward to the position shown in FIG. 2. A collar 9A at the back end of the selection establishing key 9 contacts the back end of the inner cylindrical wall 17 of the item designating dial 8. This keeps the selection establishing key 9 in the position illustrated in FIG. 2. The rubber switch 20 remains on as long as the selection establishing key 9 remains depressed. Releasing the selection establishing key 9 turns off the rubber switch 20. In an alternate embodiment, the selection establishing key 9 is provided in the left part of the machine arm 3, adjacent the start/stop switch 6.

Figure 6:
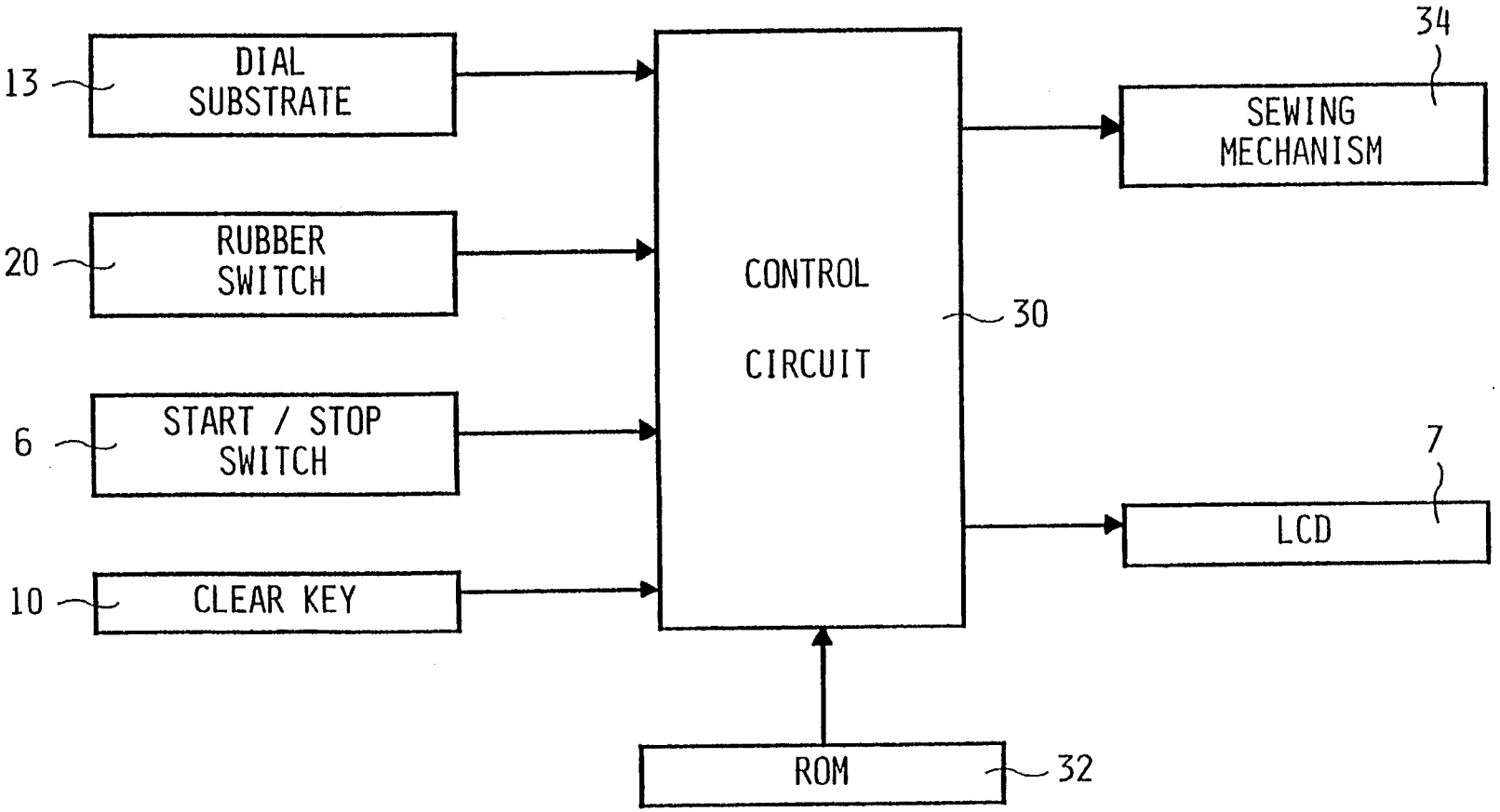
FIG. 6 is a block diagram of the control element of this invention.

FIG. 6 shows the control system of the sewing machine 1. The sewing machine 1 comprises the control circuit 30 including a microcomputer. The control circuit 30 has a ROM 32 for storing control programs for controlling the overall sewing operation of the sewing machine 1. The control circuit 30 imparts a switching signal from the switch 6, the pulse signals from the first and the second output terminal of the conductor patterns on the dial substrate 13, an establishing signal from the rubber switch 20, and a clear signal from the clear key 10.

Figure 12:
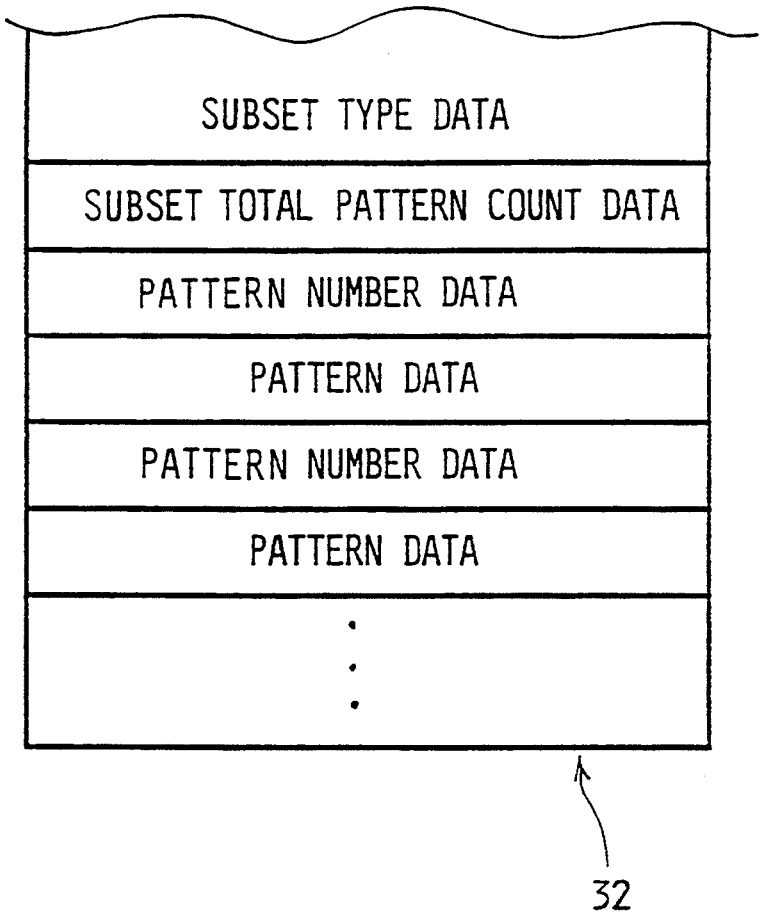
FIG. 12 is a view illustrating a typical structure of data stored in a ROM.

The ROM 32 stores data such as sewing data, data for selecting and setting pattern sewing, and data for displaying patterns. These data are read out under control of the control circuit 30. The ROM 32 may be provided within the sewing machine 1. Alternatively, the ROM 32 is a ROM card or the like which is removably attachable to the sewing machine 1. As shown in FIG. 12, the ROM 32 contains, for each type of needlework subset (e.g., utility pattern items, hiragana characters, katakana characters, alphabetic characters, frills pattern items, cartoon characters), subset type data, total pattern count data and subset total count data, pattern number data and pattern data, in that order, followed by repetitive pairs of pattern number data and pattern data. The control circuit 30 drives and controls a sewing mechanism 34, containing a sewing motor, and the LCD 7.

Figure 10:
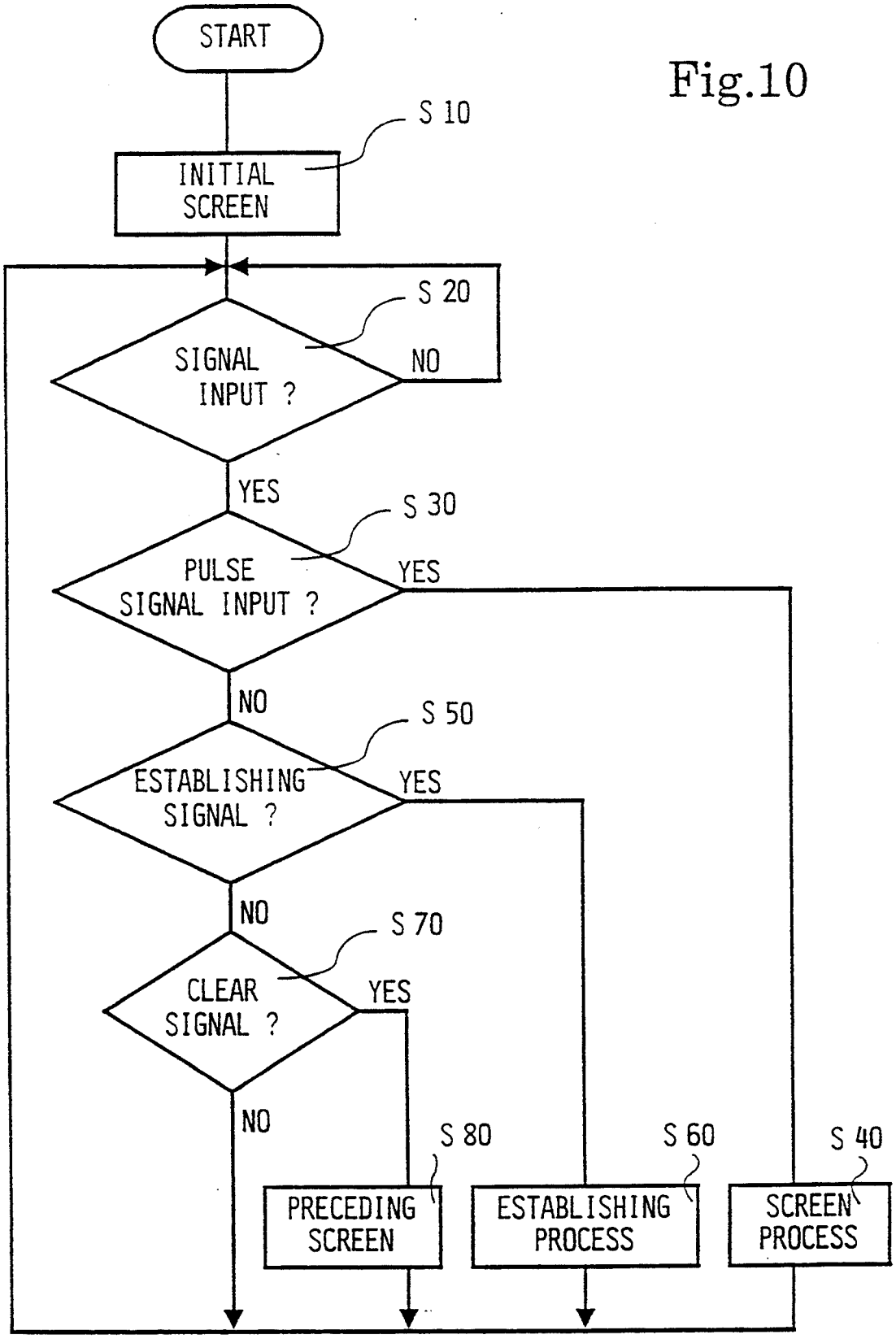
FIG. 10 is a flowchart of control steps for selecting a pattern.
Figure 11:
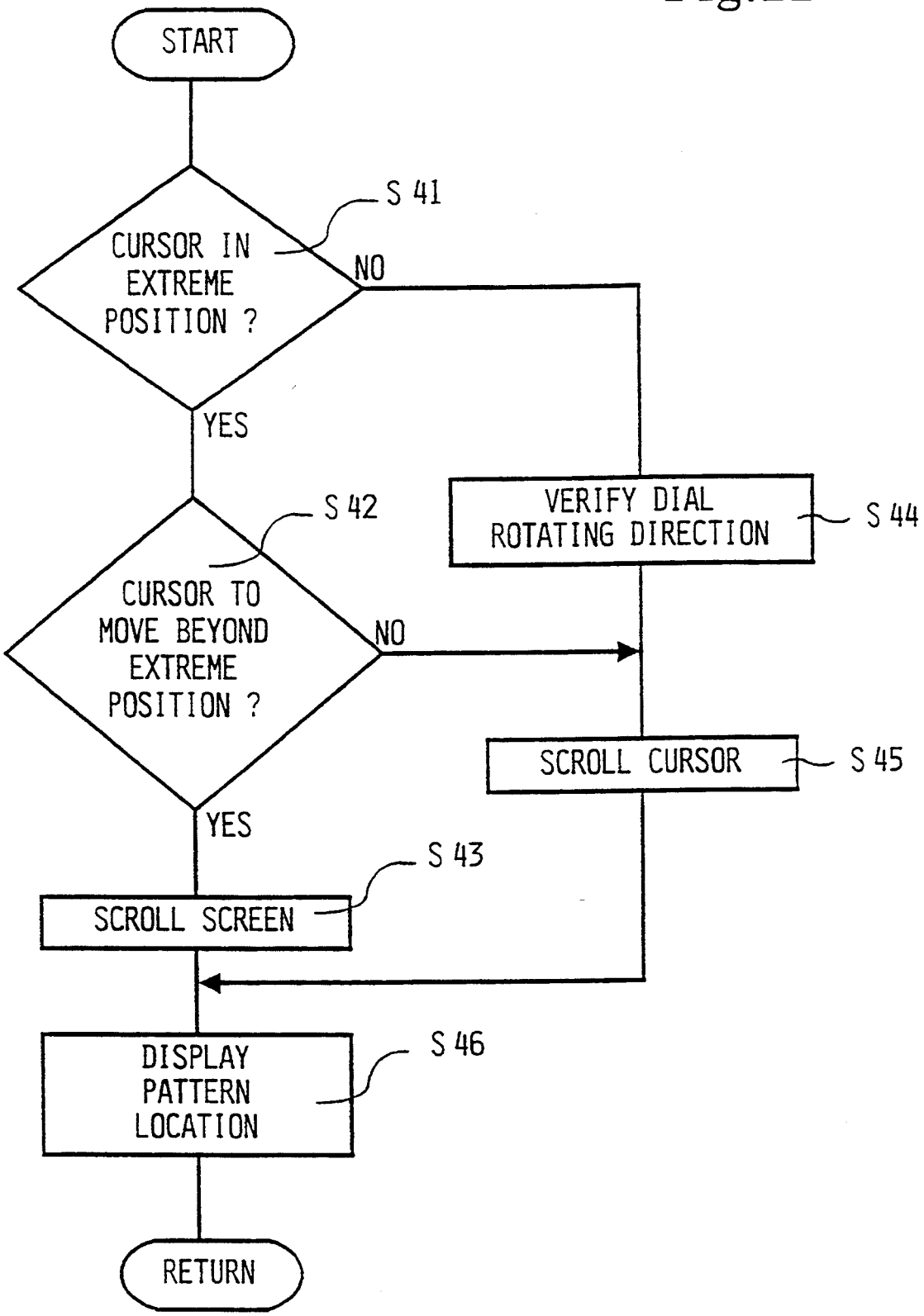
FIG. 11 is a flowchart of control steps for scrolling the display screen.

Turning on a power switch, not shown, supplies power to the sewing machine 1. With the power supplied, step 10 of FIG. 10 is entered and the LCD 7 displays an initial screen, which is shown in FIG. 7. The initial screen displays a plurality of items indicating different subsets of sewing pattern types. In this example, the subsets "utility patterns," "hiragana characters," "katakana characters," "alphabetic characters," "frills patterns" and "cartoon characters" are displayed. The cursor K initially highlights the subset "utility patterns" among the subsets displayed, as shown in FIG. 7.

Step S10 is followed by step S20, in which the control circuit 30 waits for an input signal. When the operator turns the item designating dial 8 clockwise by one depression 12A of the collar 12, the item designating dial's rotation causes the first and second output terminals of the first and second conductor patterns on the dial substrate 13 to supply the control circuit 30 with the pulse signals P1 and P2, as shown in FIG. 4. In turn, the control circuit 30 recognizes the signal input in step 20 and detects the pulse signal input in step S30. In step S30, the control circuit 30 determines that the signals entered came from the item designating dial 8 and that the item designating dial 8 was turned clockwise by one depression 12A of the collar 12. Step S30 is followed by step S40, in which the control circuit 30 drives the LCD 7 to move the cursor K one place to the right (i.e., to designate "hiragana characters"). As described above, when the operator turns the item designating dial 8 clockwise, the cursor K moves to the right by the number of depressions 12A traveled by the clockwise-rotating dial 8. The control circuit 30 then returns to steps S20 to wait for another signal input.

When the operator turns the item designating dial 8 counterclockwise by one depression 12A of the collar 12, the first and second output terminals of the first and second conductor patterns on the dial substrate 13 send the pulse signals P3 and P4 to the control circuit 30. In turn, the control circuit 30 recognizes the signal input in step S20 and detects the pulse signal input in step S30.

In step S30, the control circuit 30 determines that the received signals came from the item designating dial 8 and that the item designating dial 8 was turned counterclockwise by one depression 12A of the collar 12. Steps 30 is followed by step S40, in which the control circuit 30 drives the LCD 7 to move the cursor K one place to the left.

Occasionally, the cursor K is already in the rightmost position on the LCD 7 when the operator turns the item designating dial 8 clockwise. In that case, the cursor K, having no further position to move to the right, is moved to the leftmost position on the screen by the control circuit 30. If the cursor K is currently in the leftmost position on the screen and the operator turns the item designating dial 8 counterclockwise, the cursor K likewise moves to the rightmost position.

When the operator wants to select an alphabetic character pattern, the operator calls up the initial screen depicted in FIG. 7 and turns the item designating dial 8 clockwise by four depressions 12A. This moves the cursor K right 4 places, to reach the subset "alphabetic characters." The cursor movement is accomplished by repeating steps S20, S30 and S40 four times. To select the subset "alphabetic characters," the operator pushes the selection establishing key 9. An establishing signal from the selection establishing key 9 is input to the control circuit 30 in step S20.

In step S30, the control circuit 30 determines that the establishing signal did not come from the item designating dial 8. The "NO" decision in step S30 is followed by step S50 in which the control circuit 30 identifies the signal as the selection establishing signal. The "YES" decision in step S50 is followed by step S60, in which the control circuit 30 selects from the ROM 32 the item type data representing alphabetic characters and causes the LCD 7 to display the screen display shown in FIG. 8B. In this case, the alphabetic characters are displayed alphabetically. As shown in FIG. 8B, the characters A through E are first displayed in the lower five regions D1 through D5, respectively, of the screen.

If the operator wants to switch to another subset of items, the operator pushes the clear key 10. The clear signal from the clear key 10 enters the control circuit 30 in step S20. The "YES" decision in step S20 is followed by step S30, in which the control circuit 30 determines that the received signal did not come from the item designating dial 8. The "NO" decision in step S30 is followed by step S50, in which the control circuit 30 determines that the signal did not come from the selection establishing key 9. The "NO" decision in step S50 is followed by step S70, in which the control circuit 30 determines that the signal came from the clear key 10. Step S70 is then followed by step S80, in which the control circuit 30 selects from the ROM 32 the data representing the screen of FIG. 8A.

The control circuit 30 then returns the screen of the LCD 7 to the state (i.e., the display shown in FIG. 8A) in effect before the selection establishing key 9 was last pushed. If some other irrelevant signal is input to the control circuit 30 in step S20, the control circuit 30 determines that the received signal did not come from the item designating dial 8, the selection establishing key 9 or the clear key 10 ("NO" in steps S30, S50 and S70). In that case, the control circuit 30 returns to step S20. If the switching signal from the switch 6 is input, the control circuit 30 causes the sewing mechanism 34 to start pattern sewing in accordance with the selected and established pattern data.

As described, when the subset of items "alphabetic characters" is selected on the screen shown in FIG. 8A, the screen illustrated in FIG. 8B first appears on the LCD 7. The screen indicates only part of the plurality of patterns, i.e., five characters A through E, stored under the heading "alphabetic characters." With the subset "alphabetic characters" selected, any of the 26 alphabetic characters may be selected successively. Of the alphabetic characters, those not displayed on the LCD 7 are displayed by scrolling the displayed contents using the item designating dial 8.

As shown in FIG. 8B, the cursor K is in the leftmost position D1. In this case, the control circuit 30 determines, in step S41, if the cursor K is in an extreme position. When the control circuit 30 determines that the cursor K is in the leftmost position D1 or the rightmost position D5 ("YES" in step S41), the control circuit 30 goes to step S42. In step S42, the control circuit determines if the pulse signals from the item designating dial 8 are such that the cursor should be moved to the left from position D1 or to the right from position D5.

In the case shown in FIG. 8B, when the control circuit 30 determines that the pulse signals are P1 and P2, the control circuit 30 moves the cursor K to the right ("NO" in step S42). The "NO" decision in step S42 is followed by step S45, in which the control circuit 30 moves the cursor K one place to the right, (i.e., from "A" in the region D1 to "B" in the region D2). In step S46, the control circuit 30 retrieves the total pattern count data "26" and the number data "02" representing the pattern "B" highlighted by the cursor K from among the stored alphabetic character-related data. These data are displayed in the vertically oblong leftmost region W1 in the form of a fraction indicating where the pattern "B" is located among all the patterns under the same item heading. When the cursor K points to the character "B," the location of the designated pattern is indicated as "02/26" in the region W1.

If, in the example shown in FIG. 8B, the control circuit 30 determines that the received pulse signals are P3 and P4, the control circuit 30 moves the cursor K further left ("YES" in step S42). Since the cursor K is already in the leftmost position and cannot be moved further left, the control circuit 30 enters step S43 to scroll the patterns. That is, while the cursor K remains in the region D1, the patterns are moved to the right. As a result, the cursor K highlights "Z" in the region D1.

Figure 8C:
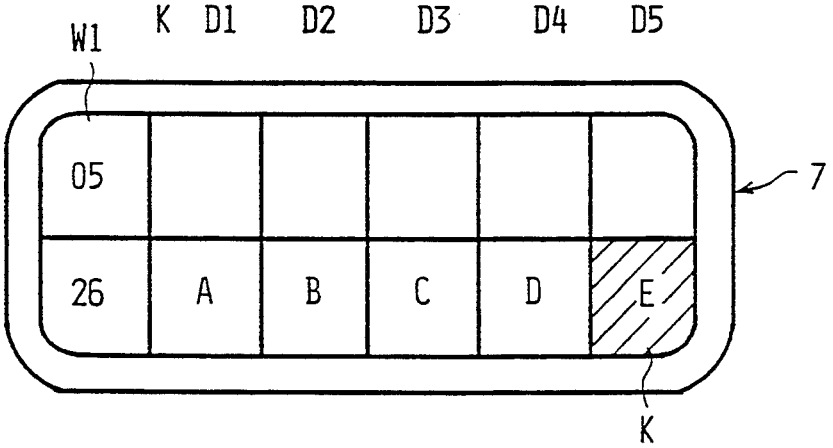
Figure 8D:
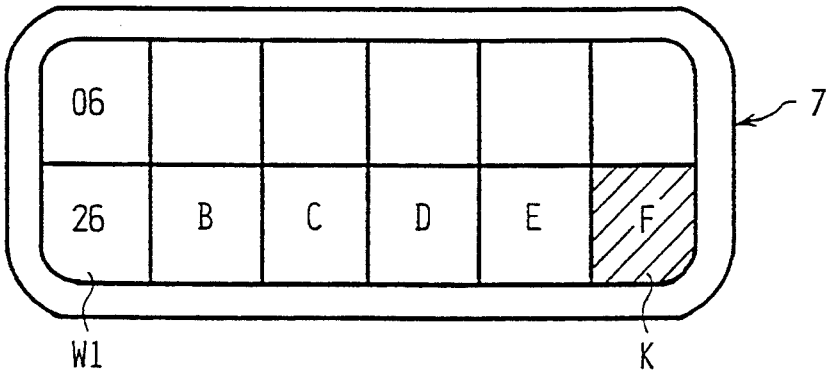

In step S46, the control circuit 30 retrieves from among the stored alphabetic character-related data the total pattern count data "26" and the number data "26" representing the pattern "Z" highlighted by the cursor K. These data are displayed in the vertically oblong leftmost region W1 in the form of a fraction indicating where the pattern "Z" is located among all the patterns under the same item heading. When the cursor K points to the character "Z," the location of the designated pattern is indicated as "26/26" in the region W1. Similarly, when the cursor K is in the right-most position, as shown in FIG. 8C and is to be moved to the right, (i.e., where the cursor K is to be moved from "E" to "F,") the cursor movement may be achieved by scrolling the patterns to the left, as shown in FIG. 8D.

If, in step S41, the control circuit 30 determines that the cursor K is in neither extreme position D1 or D5, the "NO" decision in step S41 is followed by step S44. In step S44, the control circuit 30 detects the rotation direction of the item designating dial 8 based on the pulse signals received. In step S45, the control circuit 30 moves the cursor K one place in the direction corresponding to the detected dial rotation direction. In step S46, as described above, the control circuit 30 retrieves from among the stored alphabetic character-related data the total pattern count data "26" and the number data representing the pattern currently highlighted by the cursor K. These data are displayed in the vertically oblong leftmost region W1 in the form of a fraction indicating where the displayed pattern is located among all the patterns under the same item heading.

For example, the operation of the system for selecting and sewing alphabetic characters J, A, P, A and N (i.e., making up "JAPAN") using the sewing machine 1 is described in reference to FIGS. 7–11. The operator first selects the subset "alphabetic characters" on the initial screen shown in FIG. 7, and pushes the selection establishing key 9. The resulting screen, shown in FIG. 8B, shows that the cursor K points to the character "A," the first of the patterns under the heading "alphabetic characters." At this point, the control circuit 30 indicates, in the region W1, where the pattern "A" designated by the cursor K (called the designated pattern) is located relative to the plurality of alphabetic characters. With the designated pattern "A" being the first alphabetic character, the location is indicated as "01/26" in the region W1.

The operator next selects the character "J" as follows. Because the character "J" is not currently displayed on the screen of FIG. 8B, the displayed contents need to be scrolled. The cursor K, which is movable crosswise, may be moved right 9 character positions, given that the character "J" is the 10th character, in alphabetical order, relative to the first character "A," or the 16th character, in reverse alphabetic order, when starting from the character "A." The forward cursor motion is selected as it is shorter. Thus, the operator turns the item designating dial 8 clockwise until the character "J" is reached. As described in FIG. 12, the total count of patterns and the numbers attached beforehand to the individual patterns under each item subset ("utility patterns," "hiragana characters," "katakana characters," "frills patterns" and "cartoon characters") are stored in the ROM 32.

Figure 9A:
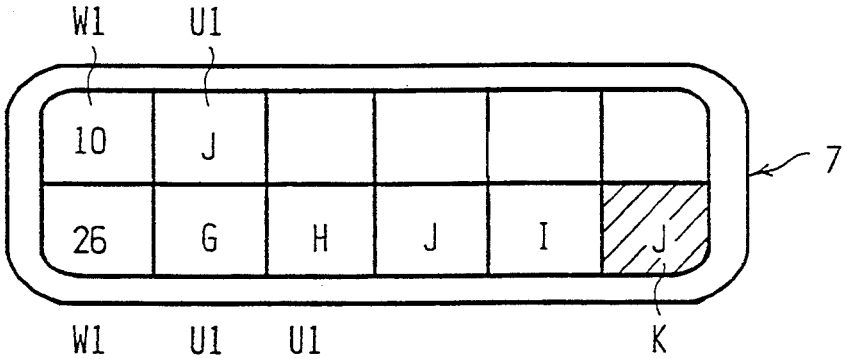
FIGS. 9A through 9E are front views of other screens as they appear on the LCD.

As shown in FIGS. 8C and 8D, the operator turns the item designating dial 8 clockwise successively to move the cursor K to the right. When the screen shown in FIG. 9A is reached, the operator pushes the selection establishing key 9 to select the character "J." In turn, the control circuit 30 displays the selected character "J" in the leftmost upper region U1 on the screen. As the movement of the cursor K changes the designated patterns, the indication of the designated pattern location in fraction form is correspondingly altered (in step 46 of the flowchart of FIG. 11). For example, the pattern location indication "05/26" appears in the region W1 when the character "E" is designated, as shown in FIG. 8C. When the character "F" is designated, the pattern location indication changes to "06/26" in the same region W1, as shown in FIG. 8D.

Figure 9B:
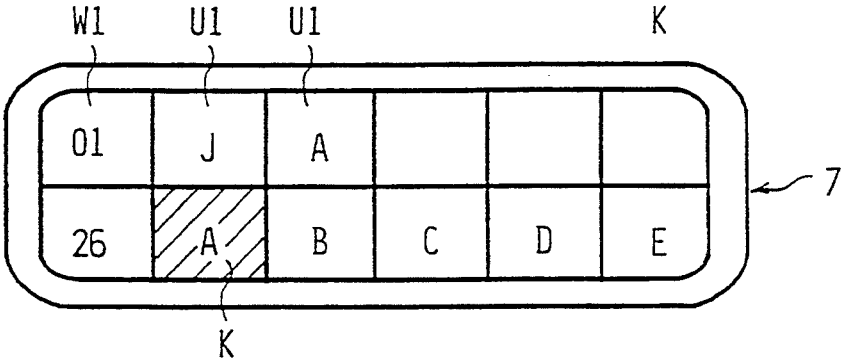

To select next the character "A" requires scrolling the screen contents, because the desired character is not found on the screen illustrated in FIG. 9A. From the character "J" to the character "A," the cursor K must move 16 character positions in alphabetic order or 9 character positions in reverse alphabetical order. Thus the operator decides to move the cursor K over the shorter distance, i.e., to the left. The operator turns the item designating dial 8 counterclockwise, until the screen depicted in FIG. 9B is reached. With the screen shown in FIG. 9B in place, pushing the selection establishing key 9 selects the character "A." The selected character "A" is displayed in the upper region U2 second from left on the screen. At this point, the pattern location indication "01/26" appears in the region W1.

Figure 9C:
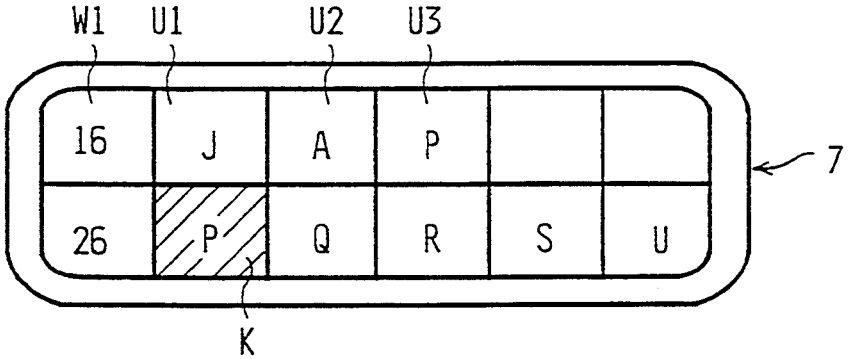

To select the next character "P" also requires scrolling the screen contents, since the desired character is not found on the screen illustrated in FIG. 9B. Possible cursor movements in either direction are calculated in the same manner as described above (15 character positions to the right or 10 to the left). The operator decides to move the cursor K over the shorter distance, i.e., to the left. The cursor K is moved to the left until the screen depicted in FIG. 9C is reached. With the screen shown in FIG. 9C in place, pushing the selection establishing key 9 selects the character "P." The selected character "P" is displayed in the upper region U3 third from left on the screen.

Figure 9D:
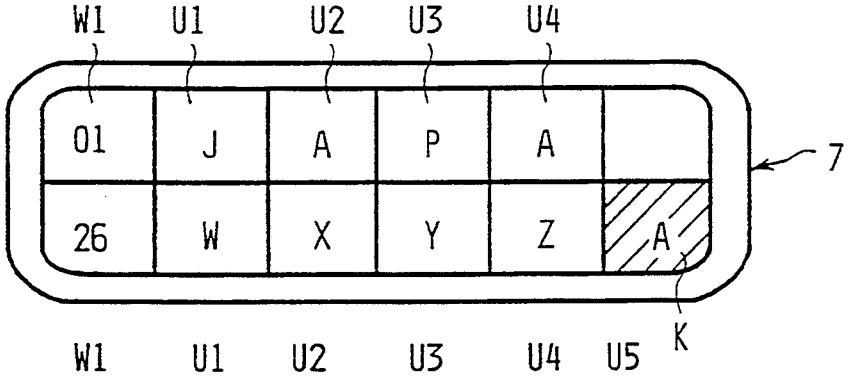
Figure 9E:
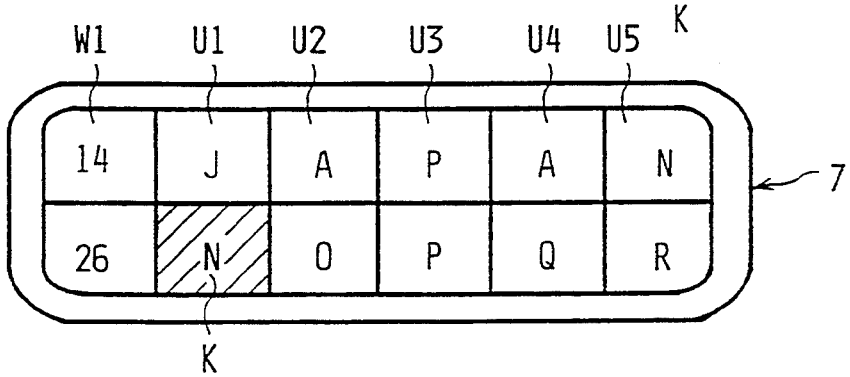

In like manner, the cursor K is moved over the shorter distance to select the character "A" on the screen of FIG. 9D and then the character "N" on the screen of FIG. 9E. (From the character "A" to the character "N," the cursor K must move the same character positions in either direction.) The desired sewing pattern "JAPAN" has now been selected. Pushing the switch 6 with the screen of FIG. 9E in place starts the sewing operation of that pattern.

As described, the embodiment of the invention indicates on its display where the displayed pattern is located relative to the patterns under the same subset heading. The indication of the pattern location allows the operator to know quickly in which direction to turn the item designating dial 8 in order to reach the desired pattern through the fewest possible dial turns. Because the exact amount by which to turn the dial is also known from that indication, excess cursor movements are eliminated. This also contributes to making the pattern selection faster than ever. An alternative use of a table describing the orders of various patterns will allow any of many more patterns to be selected quickly and easily.

While a preferred embodiment of the invention has been described using specific terms, such description is for illustrative purposes only, and it is to be understood that changes and variations may be made without departing from the spirit or scope of the following claims.

What is claimed is:

1. A sewing machine and pattern selection apparatus, comprising:
   - sewing means for sewing a selected pattern;
   - storage means for storing a plurality of patterns in a predetermined order;
   - display means for displaying a subset of the plurality of patterns stored in the storage means;
   - control means for scrolling the subset of displayed patterns displayed on the display means through the plurality of patterns in the predetermined order; and
   - position indicating means for indicating a location of one of the subset of patterns displayed on the display means relative to the plurality of patterns stored in the storage means.

2. The sewing machine and pattern selection apparatus of claim 1, wherein said position indicating means displays a first number indicative of a total number of the plurality of patterns and a second number corresponding to a position of one of the plurality of patterns in the predetermined order.

3. The sewing machine and pattern selection apparatus of claim 2, wherein said position indicating means displays the first and second numbers as a fraction.

4. The sewing machine and pattern selection apparatus of claim 3, wherein the first number is a denominator of the fraction and the second number is a numerator of the fraction.

5. The sewing machine and pattern selection apparatus of claim 1, wherein said control means further comprises:
   - scroll direction means for indicating a scroll direction when scrolling the at least one displayed pattern through the plurality of patterns;
   - pattern indicating means for indicating one of the at least one displayed pattern; and
   - pattern selecting means for selecting the indicated pattern.

6. The sewing machine and pattern selection apparatus of claim 5, wherein said position indicating means displays a first number corresponding to a total number of the plurality of patterns and a second number corresponding to a position of the indicated pattern in the predetermined order.

7. The sewing machine and pattern selection apparatus of claim 5, wherein said scroll direction means comprises a rotatable dial.

8. The sewing machine and pattern selection apparatus of claim 7, wherein said rotatable dial comprises:
   - a collar; and
   - a plurality of depressions arranged around a circumferential periphery of said collar; and
   - wherein said scroll direction means further comprises:
   - engaging means for engaging one of said plurality of depressions; and
   - pulse generating means for generating a pulse signal each time said rotatable dial is turned sufficiently to cause said engaging means to engage a different one of the plurality of depressions.

9. The sewing machine and pattern selection apparatus of claim 8, wherein pulses generated by said pulse generating means are input to said control means, said control means scrolling the at least one displayed pattern one position in the predetermined order in response to each input pulse.

10. The sewing machine and pattern selection apparatus of claim 9, wherein when said rotatable dial is rotated clockwise, said pulse generating means generates first and second pulses, said control means scrolling the at least one displayed pattern one position in an ascending direction of the predetermined order in response to each pair of first and second pulses, and when said rotatable dial is rotated counter-clockwise, said pulse generating means generates third and fourth pulses, said control means scrolling the at least one displayed pattern one position in a decreasing direction of the predetermined order in response to the third and fourth pulses.

11. The sewing machine and pattern selection apparatus of claim 7, wherein said control means scrolls the at least one displayed pattern in an ascending direction of the predetermined order in response to said dial being turned in a clockwise direction, and wherein said control means scrolls the at least one displayed pattern in a decreasing direction of the predetermined order in response to said dial being turned in a counter-clockwise direction.

12. The sewing machine and pattern selection apparatus of claim 7, wherein said pattern selection means is a button provided at a center portion of said rotatable dial.

13. The sewing machine and pattern selection apparatus of claim 5, wherein said control means scrolls the at least one displayed pattern in an ascending order of the predetermined order in response to said scroll direction means indicating a first direction and said control means scrolls the at least one displayed pattern in a decreasing order of the predetermined order in response to said scroll direction means indicating a second direction.

14. The sewing machine and pattern selection apparatus of claim 5, wherein said pattern selection means is a button.

15. The sewing machine and pattern selection apparatus of claim 5, wherein said pattern indicating means is a cursor displayed on said display means.

16. The sewing machine and pattern selection apparatus of claim 15, wherein said cursor is a reverse video display.

17. The sewing machine and pattern selection apparatus of claim 5, wherein said display means comprises a scroll portion and a selected portion, the scroll portion displaying the at least one displayed pattern and the selected portion displaying at least one selected pattern.

18. The sewing machine pattern selection apparatus of claim 1, wherein said display means is capable of displaying at least one pattern group of a utility pattern group, a hiragana character pattern group, a katakana character pattern group, an alphabet character pattern group, a frill pattern group, and a cartoon character pattern group.

19. A method for operating a sewing machine and selecting a pattern from a plurality of stored patterns, comprising the steps of:

displaying a currently indicated pattern of the plurality of patterns;

displaying a first number indicative of the plurality of patterns;

displaying a second number indicative of the currently indicated pattern;

scrolling through the plurality of patterns in a predetermined order to change the currently indicated pattern to a different one of the plurality of patterns;

updating the number indicative of the currently indicated pattern;

selecting the currently indicated pattern when it corresponds to a desired pattern; and sewing the selected pattern onto a substrate;

wherein the step of scrolling comprises determining an optimum direction of scrolling to display the desired pattern.

20. The method for operating the sewing machine and selecting a pattern of claim 19, wherein the step of displaying a currently indicated pattern comprises displaying a subset of the plurality of patterns; and displaying the currently indicated pattern of the displayed subset differently from other patterns of the displayed subset.

21. The method for operating a sewing machine and selecting a pattern of claim 19, wherein the step of displaying the first number comprises displaying the first number as a denominator of a fraction, and the step of displaying the second number comprises displaying the second number as a numerator of the fraction.

* * * * *